United States Patent [19]

Lampaert

[11] 4,326,566

[45] Apr. 27, 1982

[54] COLOR SELECTOR

[75] Inventor: Roger R. Lampaert, Ypres, Belgium

[73] Assignee: N. V. Weefautomaten Picanol, Ypres, Belgium

[21] Appl. No.: 74,337

[22] Filed: Sep. 11, 1979

[51] Int. Cl.[3] ..... D03D 47/38

[52] U.S. Cl. ..... 139/453

[58] Field of Search ..... 139/453; 66/50 R

[56] References Cited

U.S. PATENT DOCUMENTS

| | | | |
|---|---|---|---|
| 3,315,708 | 4/1967 | Scheffel | 139/453 |
| 3,554,240 | 1/1971 | Sakamoto | 139/453 |
| 3,791,418 | 2/1974 | Pfarrwaller | 139/453 |
| 4,076,054 | 2/1978 | Merisio | 139/453 |
| 4,160,468 | 7/1979 | Camprubi | 139/453 |
| 4,191,222 | 3/1980 | Marshall | 139/453 |

*Primary Examiner*—Henry Jaudon

*Attorney, Agent, or Firm*—Bacon & Thomas

[57] ABSTRACT

Device for selecting the color of weft threads in looms, characterized in that the mechanism controlling the weaving programme transmits a mechanical order to a so called color selector which converts the said order in a first electric signal which is sent to a synchronization device and is momentarily stored therein, whereas a second signal is produced by a switching disc and a contactless switch as a function of the rotation of the drive shaft of the loom, whereby the said first signal is sent by the said synchronization device to a so called color giver as soon as the said second signal has reached the said synchronization device.

10 Claims, 7 Drawing Figures

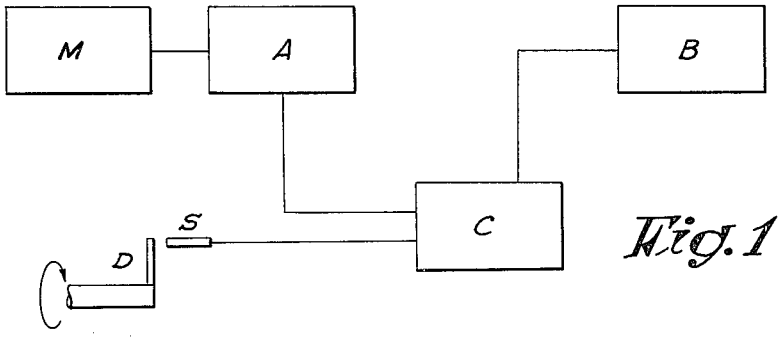
Fig. 1
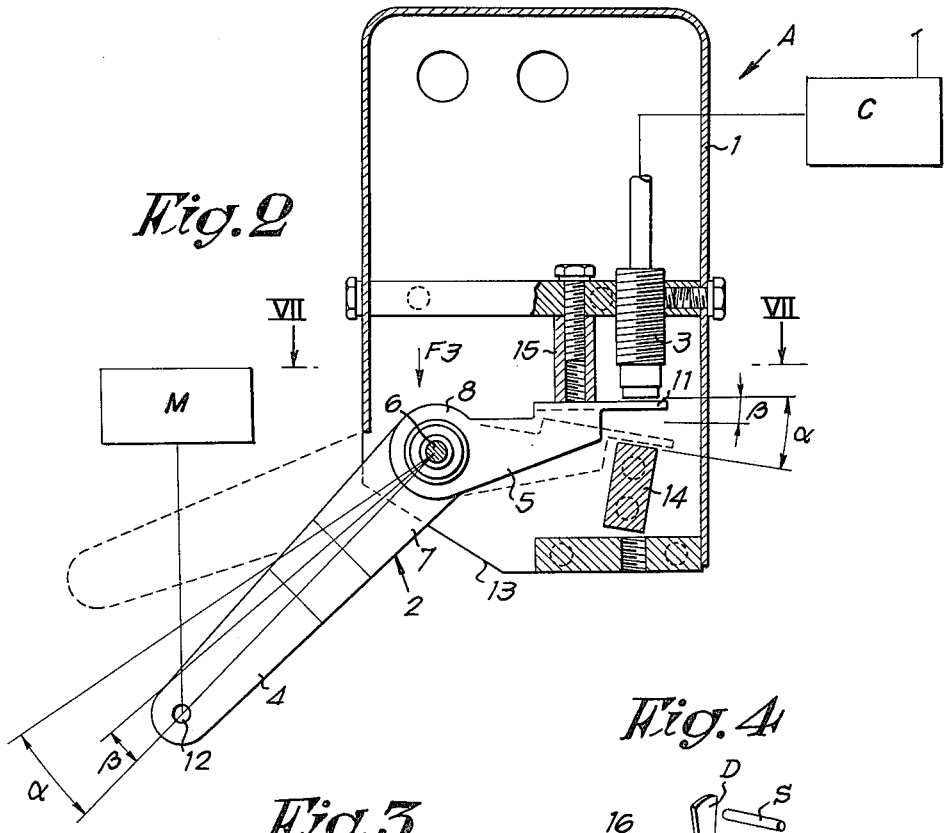
Fig. 2
Fig. 4
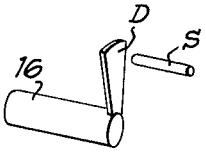
Fig. 3
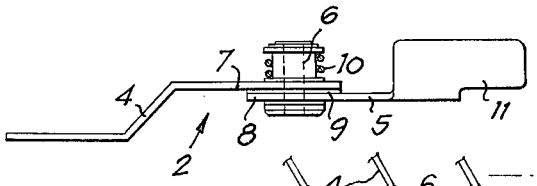
Fig. 7
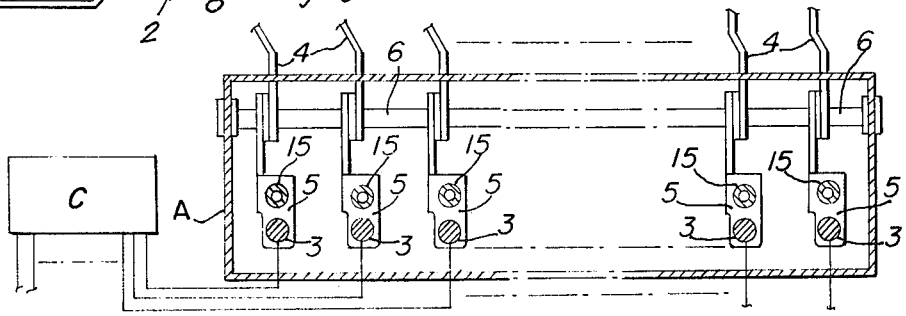

COLOR SELECTOR

The present invention relates to a device for selectively presenting weft threads of different colours to the grippers of a loom which are equipped with a Jacquard or a dobby mechanism.

It is known that the said mechanisms actuate a series of pulling hooks or levers, whereby the weaving pattern as well as the various colours may be determined in the fabric. Numerous systems are known for selecting weft threads having different colours and for presenting them to the grippers; however, a large number of said systems have important drawbacks resulting from the difficult synchronization between the Jacquard or dobby mechanism and the loom, principally at the presently applied high weaving speeds.

The object of the present invention is to prevent such drawbacks by providing a new device which has not the above-mentioned shortcomings.

According to this invention, the control for the colour selection of the Jacquard or dobby mechanism is transmitted to a double pulling hook or lever actuating a contactless switch producing a signal actuating, through a synchronization device, a device presenting a weft thread of a defined colour to the gripper as soon as the said signal is received.

The scope of this invention will be more clearly apparent from the following description of a non limitative embodiment given by way of example, reference being made to the enclosed drawings in which:

FIG. 1 is a block diagram of the whole device according to the invention;

FIG. 2 is a cross-section of the device through which the colour is selected;

FIG. 3 is a top view of the double lever according to the arrow F3 in FIG. 2;

FIG. 4 is a diagrammatic view of switching disc and the corresponding contactless switch;

FIG. 7 is a sectional view taken along line VII—VII in FIG. 2.

Figure 5:
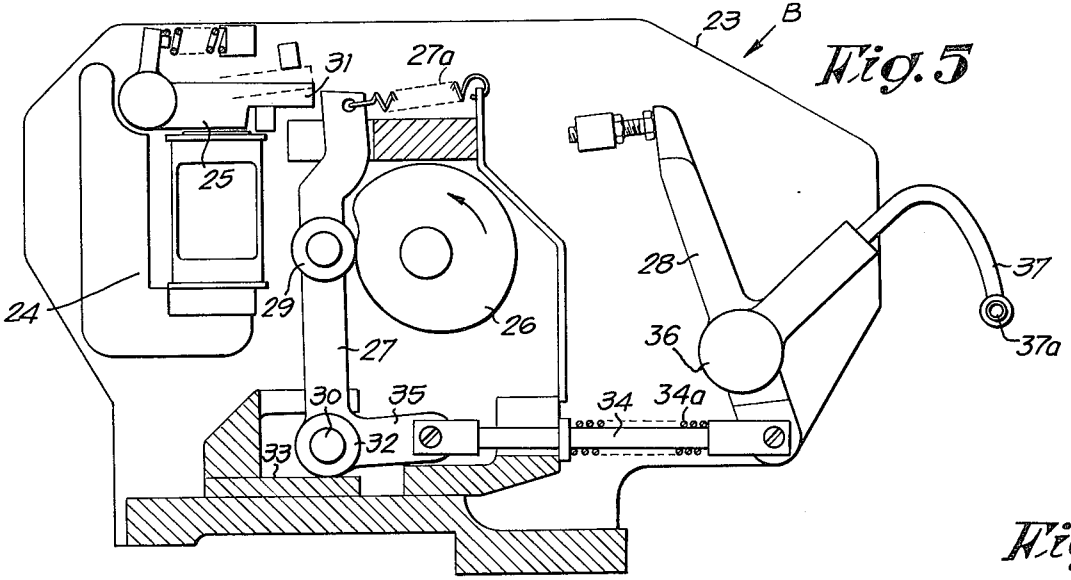
FIG. 5 is a cross-section of the device presenting the thread.

The block diagram of FIG. 1 gives a general view of the device according to the invention. As known, for each weft, the nature of the weaving pattern and the sequence of the various colours in the fabric are controlled and ordered by a Jacquard or a dobby mechanism M. These data are sent to a device consisting of a series of pulling hooks or levers, each lever relating either to the weaving pattern proper or to the colour of the weft thread being presented. However, in the present case, the levers relating to the selection of the colour of the weft thread are only considered. The device in which said levers are disposed is called a colour selector A which additionally comprises also the same number of contactless switches cooperating with the said levers. The signals emitted by said switches are synchronized in a device C with periodical signals produced by a synchronizing signal generating switching disc D mounted on the drive shaft of the loom or of the dobby or Jacquard mechanism, and a contactless switch S, whereby the synchronization weft thread color giver C transmits signals to a device B which then presents the thread to the loom gripper not shown.

FIGS. 2 and 7 show a cross-section of a colour selector A in rest position, that is to say in a position in which the concerned colour is not selected. This colour selector A comprises substantially a casing 1 in which are arranged a series of levers 2 and the same number of contactless switches 3. Each lever 2 (see FIG. 7) is actuated by the previously mentioned Jacquard or dobby mechanism M according to the colour selected by the said mechanism for the next following weft. Each lever 2 comprises two individual arms 4 and 5 which are mounted on a common axis or spindle 6 and a small friction plate 9 made of metal or synthetic material is positioned between their ends 7 and 8 receiving the common axis 6, the said ends 7 and 8 clamping the said small friction plate 9 with a defined force under the influence of a spring 10 mounted on the axis 6 and reacting against the pin 6 and the end 7 of arm 4. The arm 5 of the lever 2 has a folded plate-shaped end 11, whereas the end 12 of the arm 4 is provided to cooperate with the Jacquard or dobby mechanism M. The casing 1 has a groove-shaped opening 13 in which the arm 4 of the lever 2 may be freely shifted upwardly and downwardly according to the control of the mechanism M. In the casing 1 is provided a stop 14 preventing the small plate 11 of the arm 5 from being spaced too far from the contactless switch 3 when the arm 4 is moved upwardly. Thus, during the upwards movement of the arm 4, the arm 5 is firstly subjected to a corresponding downwards movement under an angle $\alpha$ until the small plate 11 is retained by the stop 14. When the arm 4 is then still moved further upwardly under the influence of the mechanism M, the ends 7 and 8 of the arms 4 and 5 will be displaced relative to each other on the small friction plate 9. However, as soon as the arm 4 is again shifted downwardly, the arm 5 will be immediately subjected to an upwards movement resulting from the constant friction between the ends 7 and 8 of the arms 4 and 5, namely the friction caused by the small friction plate 9 and the pressure of the spring 10. Thus, already after a minimum downwards movement of the arm 4, the contactless switch 3 will be activated by the small plate 11, which provides a substantial saving of time since it is not necessary to wait until the arm 4 is situated in its lowest position for activating the switch 3. The maximum distance on which the small plate 11 may be moved, corresponds to the angle $\alpha$ and is determined by the position of the stop 14, on one hand, and of a stationary stop 15 on the other hand. The contactless switch 3 must be so adjusted that, in the highest position of the small plate 11, a free space is always kept between the said plate 11 and the lowermost portion of the contactless switch 3. The distance on which the small plate 11 must be shifted in order to deactivate the switch 3, corresponds to the angle $\beta$ and is characteristic for the used contactless switch.

When the arm 4 is in its highest position as shown with dotted lines in FIG. 2, or, in the same manner, when the small plate 11 is in its lowest position, the contactless switch 3 is deactivated, thereby producing the signal indicating that the concerned colour has been selected.

According to the invention, the signal for a colour selection may be produced in two ways.

The first way relies on the application of a simple system whereby for each individual colour, there is provided only one double lever and, accordingly, also only one contactless switch. Owing to the fact that this method requires only one lever per colour, some difficulties may be experienced, more particularly when manufacturing multicoloured fabrics which have also an intricated structure pattern since the total number of available levers is limited.

Nevertheless, this system is advantageous in that, in case of rupture of a lever, no colour is presented and, consequently, after the weft control, the loom is immediately stopped since no weft is presented.

The second way of producing a signal for colour selection comprises using a binary system, whereby n switches are sufficient for selecting $2^n$ different colours by connecting them together to produce signals in combination. This method relies on the deactivation of the contactless switches according to the binary system, in other words the selection of a colour is, in the present case, depending on the fact that a small number of various switches are activated or not. An example of a binary colour selection is given in the following table representing three switches, for example, connected together to produce signals in combination, and wherein 1=activated and 0=deactivated.

TABLE

| Colour | Switch 1 | Switch 2 | Switch 3 |
|---|---|---|---|
| Red | 1 | 1 | 1 |
| Blue | 0 | 1 | 1 |
| Yellow | 1 | 0 | 1 |
| Green | 0 | 0 | 1 |
| Purple | 1 | 1 | 0 |
| Orange | 0 | 1 | 0 |
| White | 1 | 0 | 0 |
| Black | 0 | 0 | 0 |

It is apparent that such a system could be readily extended for more than 8 colours. For instance, a fourth switch for selecting 16 different colours could be used. This method has a great advantage in that a very small number (n) of levers is required in order to allow the appliction of a large number ($2^n$) colours.

Whatever the used method will be, the colour selector will continuously produce signals corresponding with the colour selected at any moment by the mechanism M. As a consequence of the presently used high weaving speeds, it is necessary to bring these signals for the colour selection into perfect synchronization with the rotation of the loom, in other words, care must be taken so that the pulses produced in the colour selector are perfectly introduced at the exact moment in the colour giver B. It is the reason why each of the said pulses is firstly stored in a synchronization device C until the said synchronization device receives a pulse coming from the contactless switch S which is periodically activated and deactivated by a synchronizing disc D mounted on a drive shaft 16 of the loom or the dobby or Jacquard mechanism. The disc D passes periodically before the contactless switch S, thereby producing every time a pulse. The position of the disc D relative to the zero position of the rotating axis of the loom is very critical with respect to the obtaining of a perfect synchronization for presenting the thread to the gripper.

Figure 6:
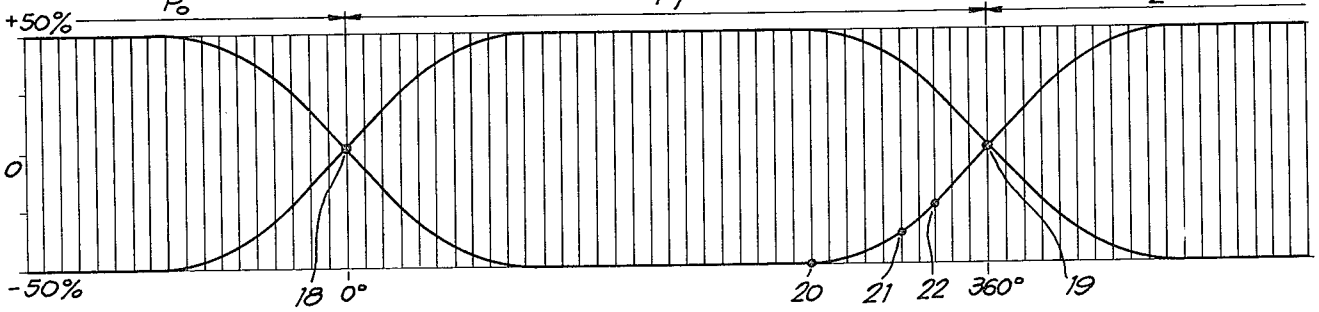
FIG. 6 is an operating diagram showing the relation between the opening of the shed and the rotation of the axis of the loom.

FIG. 6 shows a diagram representing the shed opening, in ordinate, as a function of the rotation, in abscissa, of the axis of the loom. This diagram shows the second half portion of a period $P_0$, a full period $P_1$ and the first half portion of the following period $P_2$. The points 18–19 show respectively the beginning and the end point of the full period $P_1$.

At the point 20 of the period $P_1$, the shed begins to close again and the arm 4 of the lever 2 is in its lowest position when the colour corresponding to said lever 2 has not been selected for the weft corresponding to the preceding period $P_0$. However, if said colour is now selected for the following period $P_2$, from the moment corresponding to the point 20, the arm 4 of the lever 2 will be shifted upwardly and the arm 5 will follow this movement in the opposite direction. As soon as the arm 5 is rotated downwardly under an angle $\alpha$, the contactless switch 3 is deactivated, thereby producing the signal for the colour selection. This occurs when the axis of the loom is rotated in the period $P_0$ through an angle corresponding with the point 21 in the diagram of FIG. 6. When the arm 4 moves further upwardly, the arm 5 will be further shifted downwardly until this movement is blocked by the stop 14. The maximum distance on which the arm 5 may be moved downwardly, is determined by the angle $\alpha$.

The arm 4 may then continue moving upwardly, but the arm 5 is kept in rest position against the stop 14. This is possible owing to the already described double construction of the lever 2.

It is thus apparent that the signal for the colour selection of a weft corresponding to a period $P_2$ is already produced during the second half portion of the preceding period $P_1$. In order to provide the synchronization with the movement of the colour giver B, a pulse must be also produced by means of the already mentioned damping disc D and the contactless switch S which are situated outside the colour selector A, whereby the frequency with which the switch S is activated and deactivated is directly influenced by the angular speed of the axis of the loom. The damping disc D is preferably adapted at about 270° relative to the zero point of the rotating shaft of the loom. The so produced pulse is periodically repeated and it coincides at the soonest with the pulse of the colour selector A (indicated at the point 21), and essentially a long time before the moment at which the gripper penetrates the shed of the following period $P_2$. The moment at which this pulse is generally produced is indicated by way of example in the diagram by the point 22. Simultaneously, the signals coming from the colour selector are then also transmitted to the colour giver B (FIG. 5).

The colour giver B comprises substantially a casing 23 in which an electromagnet 24, a hinged armature 25, a cam 26, an intermediate lever 27 and a lever 28 are provided for each individual colour. When a colour is selected by the mechanism M and via the colour selector A, the pulse produced therein is transmitted at the suitable time, through the synchronization device C, to the colour giver B, thereby energizing the electromagnet 24 and pulling downwardly the hinged armature 25.

Through a small wheel cam follower 29, a cam 26 imparts a swinging movement to the intermediate lever 27. When no signal is produced for the colour selection, in other words when the hinged armature 25 is in its highest position, the intermediate lever 27 will be able to pivot freely about the axis 30 under the influence of cam 26 since its upper end is not retained by the hinged armature 25 and since the upper spring **27*a* offers less resistance than the spring 34*a* shown about bar 34**, thus the thread of the concerned colour will not be presented to the gripper.

However, if the colour is selected, the hinged armature 25 is then attracted by the electromagnet 24 and its end 31 will prevent the swinging movement of the upper end of the intermediate lever 27. As a consequence of the constant movement of cam 26, in the present case, the lower end of the intermediate lever 27 will be periodically tilted about the end 31 of the hinged armature 25 so that the axis 30 is laterally reciprocated to the left along the guide 32, thereby also driving an intermediate bar 34 connecting the end 35 of the intermediate lever 27 with the lever 28 which is rotatably mounted relative to an axis 36. As a consequence of this movement, the arm 37 fixedly secured on the lever 28 will present periodically the thread of the desired colour to the gripper, the thread passing through eyelet 37*a* of arm 37. It is apparent that a similar device must be provided for each different colour.

It should be noted that numerous modifications may be applied to the device described in the foregoing by way of example without departing from the scope of this invention.

What I claim is:

1. A weft thread colour selector for a loom including a weaving pattern control (M), a weft thread giver (B) for multiple weft thread colour and a shaft (16) rotatable in synchronism with the loom drive shaft, comprising:

a colour selector (A) including means (2) for receiving mechanical input movement under control of said weaving pattern control, said input movement corresponding to a weft thread colour selection;

said colour selector including electrical colour selection signal generating switches (3) arranged to be selectively activated by said input movement receiving means;

a synchronizing device (c) electrically connected to said colour selector and arranged to receiving electrical colour selection signals from said colour selector and to temporarily store said signals;

a synchronizing signal generator (D,S) including an element (D) moveable in synchronization with the loom drive shaft for generating an electrical synchronizing signal;

said synchronizing device electrically connected to said synchronizing signal generator and arranged to receive synchronizing signals generated by same, and to transmit a stored colour selection signal only when it receives a synchronizing signal;

said weft thread giver being electrically connected to said synchronizing device and including an electrically operated control means (24) arranged to receive said colour selection signal and to cause the weft giver to present a selected coloured thread in response to said colour selection signal.

2. A weft thread colour selector as claimed in claim 1, said colour selector comprising a housing (1);

said means for receiving input movement comprising a plurality of levers (2) mounted on said housing;

said colour selection signal generating switches comprising contactless switches (3) associated with respective levers;

each of said levers comprising dual arms (4,5) rotatably mounted on a common shaft (6) and frictionally connected together at the comon shaft, whereby one arm frictionally drives the other arm about said shaft when the one arm receives input motion that moves said one arm about the shaft.

3. A weft thread colour selector as claimed in claim 2, including a friction plate (9) for frictionally connecting the arms together, said plate clamped between the arms by a spring (10) coextensive with said common shaft.

4. A weft thread colour selector as claimed in claim 2, one of the arms (4) of said levers arranged to receive the input movement under control of the weaving pattern control (M), the other arm (5) arranged to activate and deactivate the contactless switches (3), said other arms (5) each including a turned over flat portion (11) that cooperates with a respective contactles switch.

5. A weft thread colour selector as claimed in claim 4, said housing including slots (13) through which said one arm (4) of said levers projects for receiving the input movement, said slots accommodating reciprocal movement of said arms (4).

6. A weft thread colour selector as claimed in claim 4, including opposed stop means (14,15) for limiting the degree of movement of said outer arm (5) of each lever, the freedom of movement of the arms (5) that cooperate with the switches (3) being less than the freedom of movement of the arms (4) arranged to receive the input motion from the weaving pattern control (M).

7. A weft thread colour selector as claimed in claim 2, said weaving pattern control and each of said colour selection signal generating switches arranged to generate a single signal per colour selection.

8. A weft thread colour selector as claimed in claim 2, said weaving pattern control and each of said colour selection signal generating switches arranged to generate a plurality of signals in combination per single colour selection.

9. A weft thread colour selector as claimed in claim 1, said element (D) of said synchronizing signal generator (D,S) comprising an element arranged to cooperate with a contactless switch (S), said element located at the 270° position of rotation of the loom drive shaft.

10. A weft thread colour selector as claimed in claim 1, said weft thread giver including a giver arm (37) including a weft thread eyelet (37*a*), a continuously driven cam driver (26) for the giver arm, the cam driver driven by the loom drive shaft, an electromagnet (27) electrically connected to the synchronizing device, and a motion blocking element (31) moveable under control of the electromagnet for enabling or disabling movement of the giver arm in response to cam driver movement depending on the colour selection signal received from the synchronizing device.

* * * * *